United States Patent [19]

Van Berkum

[11] 4,264,297

[45] Apr. 28, 1981

[54] CONTROL SYSTEM FOR COMBUSTION APPARATUS

[76] Inventor: Robert A. Van Berkum, 117 Fernwood Rd., Chagrin Falls, Ohio 44022

[21] Appl. No.: 949,899

[22] Filed: Oct. 10, 1978

Related U.S. Application Data

[62] Division of Ser. No. 750,647, Dec. 15, 1976, Pat. No. 4,157,238.

[51] Int. Cl.[3] ..... F23N 5/00

[52] U.S. Cl. ..... 431/76; 431/12; 431/20; 431/90; 236/15 BD; 236/15 E

[58] Field of Search ..... 431/20, 76, 12, 89, 431/90; 122/448 R; 236/15 BD, 15 E

[56] References Cited

U.S. PATENT DOCUMENTS

| | | | |
|---|---|---|---|
| 1,773,705 | 8/1930 | Doran | 236/15 E |
| 1,855,559 | 4/1932 | Peabody | 431/20 X |
| 2,326,230 | 8/1943 | Klinker | 431/20 X |
| 3,814,570 | 6/1974 | Guigues et al. | 431/12 X |
| 3,840,323 | 10/1974 | Eckerle et al. | 431/90 |
| 3,843,310 | 10/1974 | Massi | 431/90 |

*Primary Examiner*—Samuel Scott
*Assistant Examiner*—Randall L. Green
*Attorney, Agent, or Firm*—Fay & Sharpe

[57] ABSTRACT

Apparatus and method for changing the calibrated linkage relationship between two flow control devices of combustion apparatus without impeding the normal operation of the associated process. Means are provided, responsive to remote, manual or automatic control, to calibrate a jackshaft linkage type of control apparatus in order to provide for range changes and zero adjustment.

4 Claims, 11 Drawing Figures

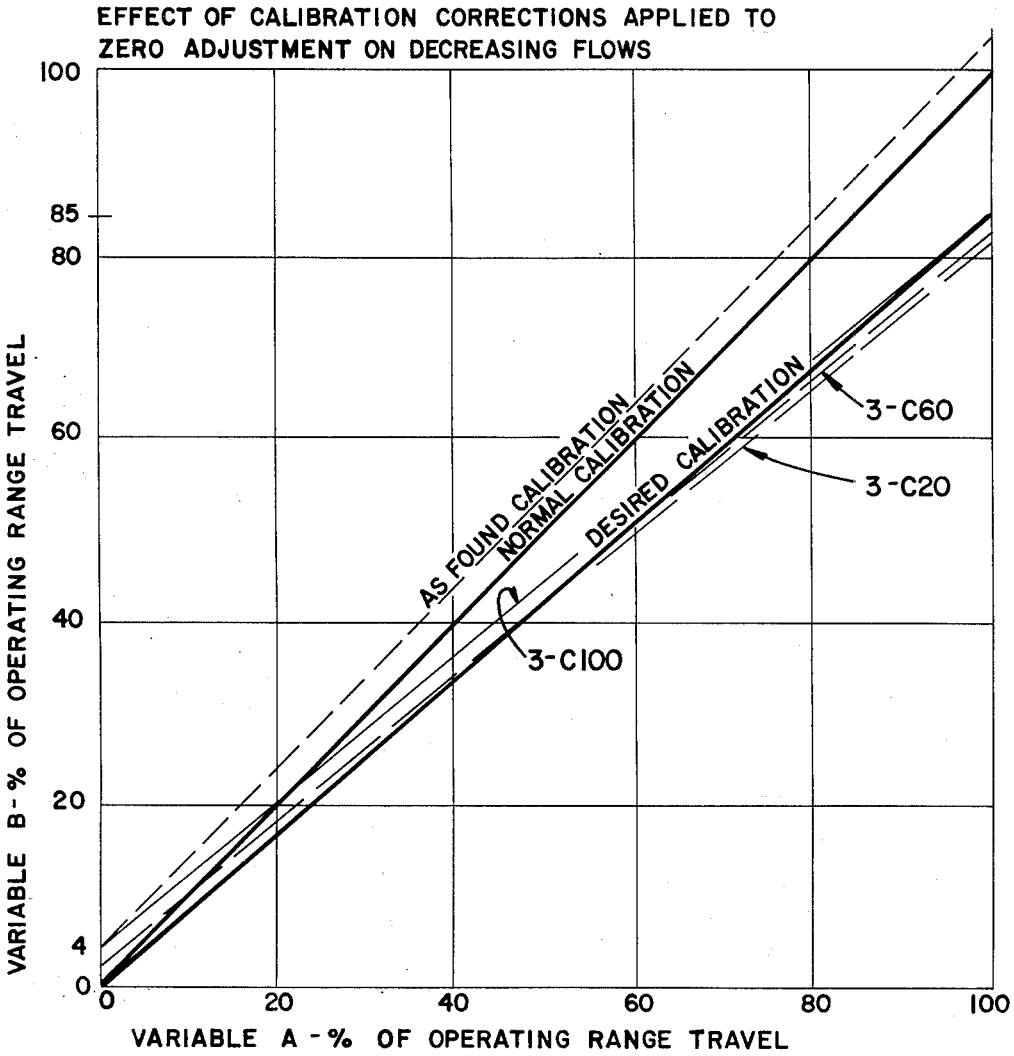
FIG. 8
FIG. 9
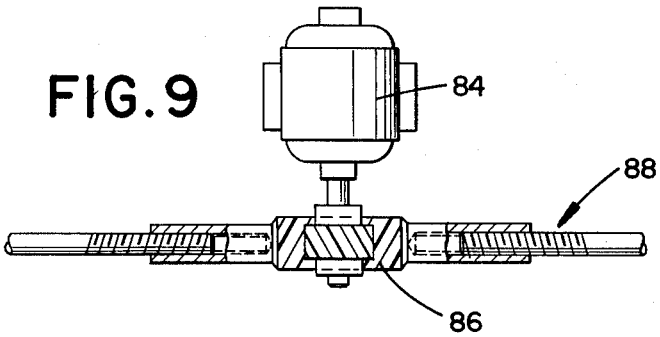

CONTROL SYSTEM FOR COMBUSTION APPARATUS

This is a division of application Ser. No. 750,647, filed Dec. 15, 1976, now U.S. Pat. No. 4,157,238.

BACKGROUND OF THE INVENTION

In the process of combustion of liquid or gaseous fuels in combustion apparatus, the flow of combustion air must be controlled in relation to fuel flow to maintain the most efficient practical air to fuel ratio.

A common way of achieving air/fuel ratio control is by interconnecting the devices which regulate the flow of air and fuel with a mechanical linkage which is calibrated to provide the desired air to fuel ratio throughout the operating range of the combustion apparatus. Typically a jackshaft system is employed for maintaining a predetermined air to fuel ratio in prior art combustion control apparatus.

A disadvantage of the jackshaft system is that no convenient means is available for compensating the initial air to fuel calibration for changing conditions such as heating value of the fuel, air density and humidity, draft losses, burner wear, and the like. If, at a given operating point one were to adjust the linkages of the jackshaft system to obtain a specific air to fuel ratio at that point, it is most likely that this adjustment would result in the air to fuel ratio being incorrect at many of the other load points. To make an adjustment which will be substantially correct throughout the load range requires that the position of the air and fuel control devices be accurately established under the desired operating conditions at representative load points throughout the operating range, and the interconnecting linkage be recalibrated to provide this position relationship at those load points.

SUMMARY OF THE INVENTION

This invention provides a means of conveniently changing by manual or automatic means the calibrated linkage relationship between two flow control devices of combustion apparatus without impeding the normal operation of the associated process.

Briefly described this invention provides for the interconnection of variable linkage means between a jackshaft and at least one flow control device, the variable linkage means being responsive to a control signal to change the calibration between the flow control devices. In the preferred embodiment the variable linkage means is comprised of a piston and cylinder assembly interconnected into a lever arm and connecting link interconnecting a jackshaft with at least one flow control device.

The invention is also directed to a method for changing the calibrated linkage relationship between two flow control devices of combustion apparatus.

BRIEF DESCRIPTION OF THE DRAWINGS

The preferred embodiment of the invention will be described with reference to the accompanying drawings in which:

FIG. 2A shows schematically original calibration of the system. FIG. 2B shows schematically a calibration adjustment for 10% less air flow to the combustion apparatus;

FIG. 8 is a graphic representation of a calibration zero adjustment made on decreasing flows; and FIG. 9 is a schematic representation of a modified form of linkage adjustment apparatus.

DESCRIPTION OF THE PREFERRED EMBODIMENT

Before proceeding with the description of the preferred embodiment reference will first be made to FIG. 1A which illustrates a typical prior art arrangement commonly used on boilers and other combustion apparatus to maintain a predetermined air to fuel ratio. The system of FIG. 1A is commonly known as a jackshaft system.

Figure 1A:
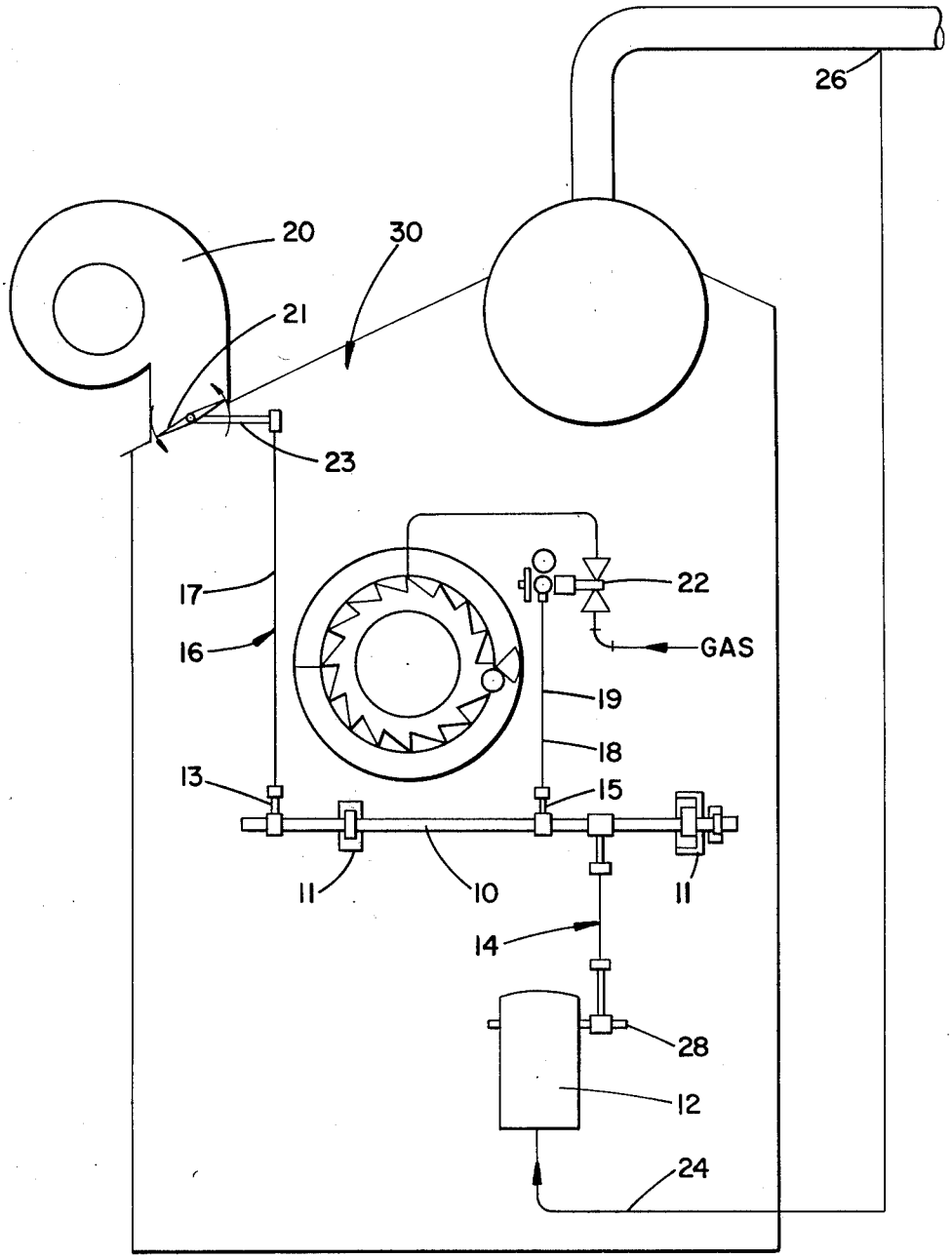
FIGS. 1A and 1B are schematic views illustrating typical prior art jackshaft control systems for combustion apparatus.

There is shown in FIG. 1A combustion apparatus designated generally as 30. Two flow control devices designated 20, 22 provide for a flow of air and fuel to the combustion apparatus. Flow control device 20 is a fan having a damper 21. Flow control device 22 is a fuel valve having means to regulate the flow of natural gas or other fuel to the combustion chamber of apparatus 30. A jackshaft 10 is mounted on suitable bearings 11 and is adapted to be rotated by means of drive motor 12. Drive motor 12 is connected to jackshaft 10 by means of linkage 14. A plurality of linkages 16, 18 interconnect jackshaft 10 with flow control devices 20, 22. Linkages 16, 18 are made up of levers 13, 15 fixed to the jackshaft 10 and links 17, 19. The drive motor 12 is controlled electrically or pneumatically by means of circuit 24 responsive to a suitable sensing apparatus connected to the combustion apparatus outlet generally designated 26. It should be appreciated from a study of FIG. 1A that rotation of the output shaft 28 of drive motor 12 produces rotation of jackshaft 10 with associated control of flow devices 20, 22 through respective linkages 16, 18.

Figure 1B:
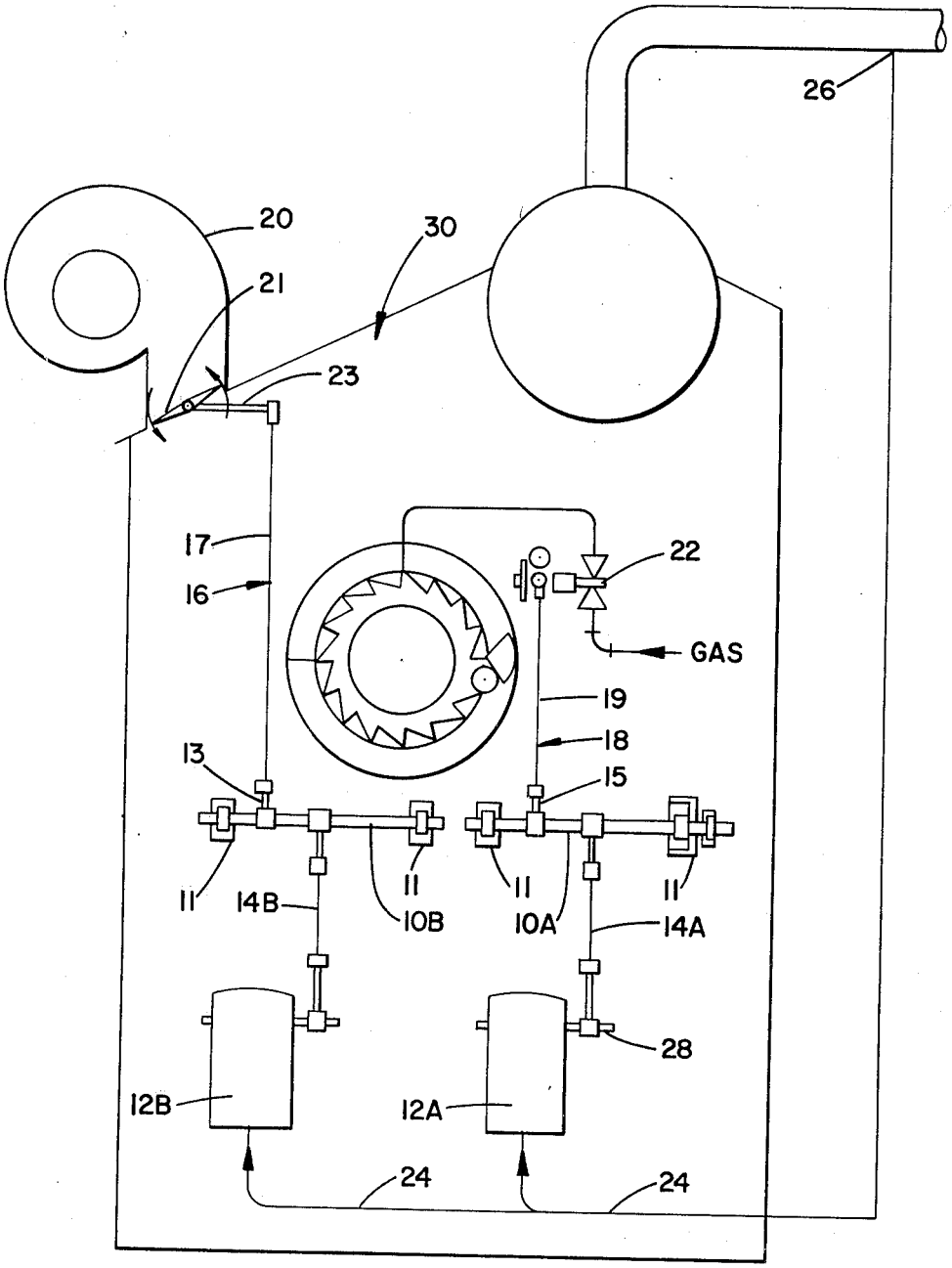

In FIG. 1B there is shown a further prior art arrangement used on boilers which is referred to as a split jackshaft system. In this system drive motors 12A, 12B provide rotation means for jackshaft 10A, 10B through respective linkages 14A, 14B. The drive motors 12A, 12B receive a common signal 24 from outlet 26. Each of the drive motors thus operates a flow control device based on an input from a common signal 24.

A principal shortcoming of the jackshaft control apparatus of FIG. 1A or 1B will now be described with reference to FIGS. 2A and 2B.

Figure 2A:
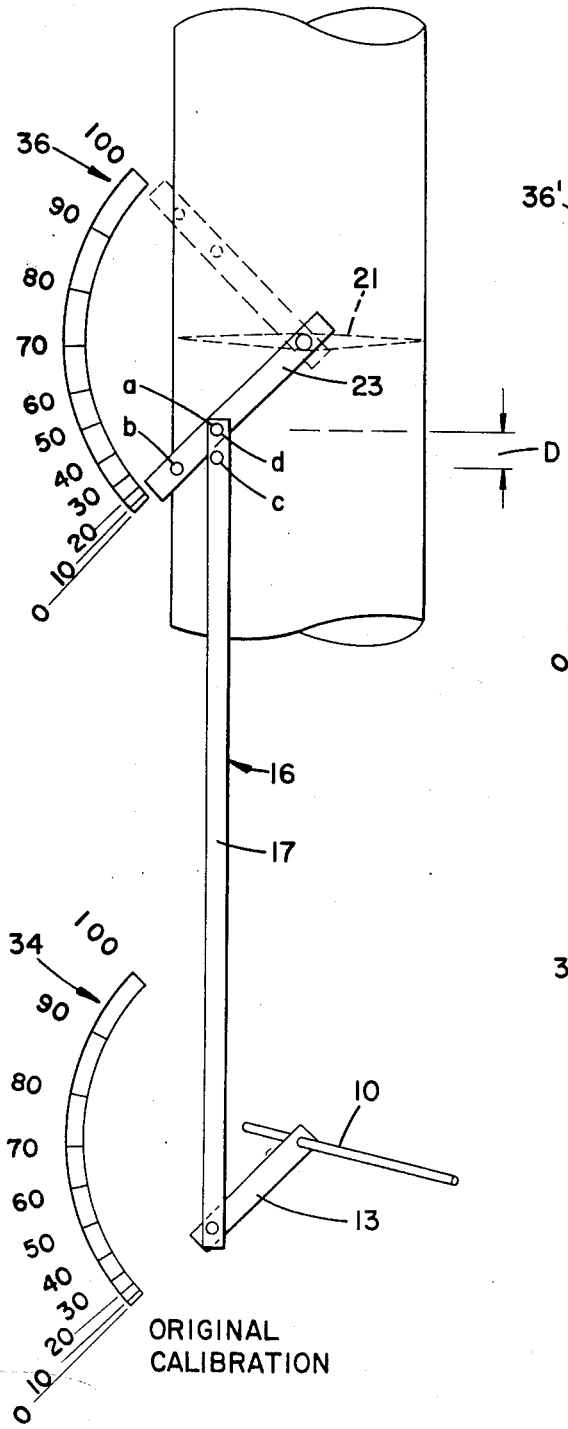
FIGS. 2A and 2B are schematic representations of a linkage employed in a prior art jackshaft system of the type shown in FIGS. 1A and 1B.

Referring first to FIG. 2A there is shown schematically jackshaft 10, lever 13 (which will be referred to as the driving lever), connecting link 17, driven lever 23 and damper 21. The elements just described with reference to FIG. 2A should be understood to be similar to elements shown and described in connection with the schematic representation of FIG. 1A.

The scale markings in FIG. 2A represent percentage boiler load positions of the operating levers.

It should be understood that while the jackshaft 10 as shown in FIG. 2A is shown interconnected into the linkage extending from the damper 21, the jackshaft may also operate a fuel valve. In this respect the jackshaft may be connected to the fuel valve by means of a linkage mechanism (such as is shown in FIG. 1A) or alternately, the jackshaft may operate the fuel valve through a cam mechanism or other means. As shown in FIG. 1B a separate jackshaft may be used to operate the fuel valve.

At original calibration the burner service technician very carefully arrives at a linkage and fuel calibration which, at any load, places the damper in the correct position relative to the fuel valve such that the proper air flow-fuel flow ratio for that firing rate is attained. The schematic representation of FIG. 2A shows the linkage 16 fixed as a result of original calibration. Rotation of the jackshaft 10 will cause similar rotation of driving lever 13 through a specified segment of scale 34. In turn, the driven lever 23 will cause to be rotated through a specified segment of scale 36. The degree of rotation of driving lever 13 with respect to driven lever 23 will vary in a fixed ratio dependent upon the length of driving lever 13, the length of connecting link 17 and the length of driven lever 23.

Operating conditions change, however, making it desirable to recalibrate the control system of combustion apparatus. For example, changes in air temperature and relative humidity will affect the amount of oxygen delivered to the burner for a given damper position. Changes as much as 19% may be experienced. Similarly, changes in fuel heating value, viscosity, and specific gravity will produce changes as will the point of origin of the fuel burned. Obviously, the original calibration is correct for the "as found" conditions at time of calibration. Changing conditions such as noted above require a new "tune up" in the control apparatus.

Assume a change in conditions which requires 10% less air flow relative to the fuel valve than is provided for in the original calibration. The recalibration for a 10% less air flow condition is shown schematically in FIG. 2B. Comparing scale 36' of FIG. 2B with scale 36 of FIG. 2A it will be noted that the new damper lever positions for boiler loads from 0 to 100% are respectively 10% less in FIG. 2B as compared to FIG. 2A. That is to say, the distance between the 0 and 100% gradations on scale 36' of FIG. 2B is approximately 90% of the distance between the 0 and 100% gradations of scale 36 of FIG. 2A. Note, however, that the 0 position of the damper driven lever has not changed from FIG. 2A to FIG. 2B. Each subsequent gradation is, however, 10% less on the scale 36' of FIG. 2B than comparable gradations on the scale 36 of FIG. 2A.

Figure 2B:
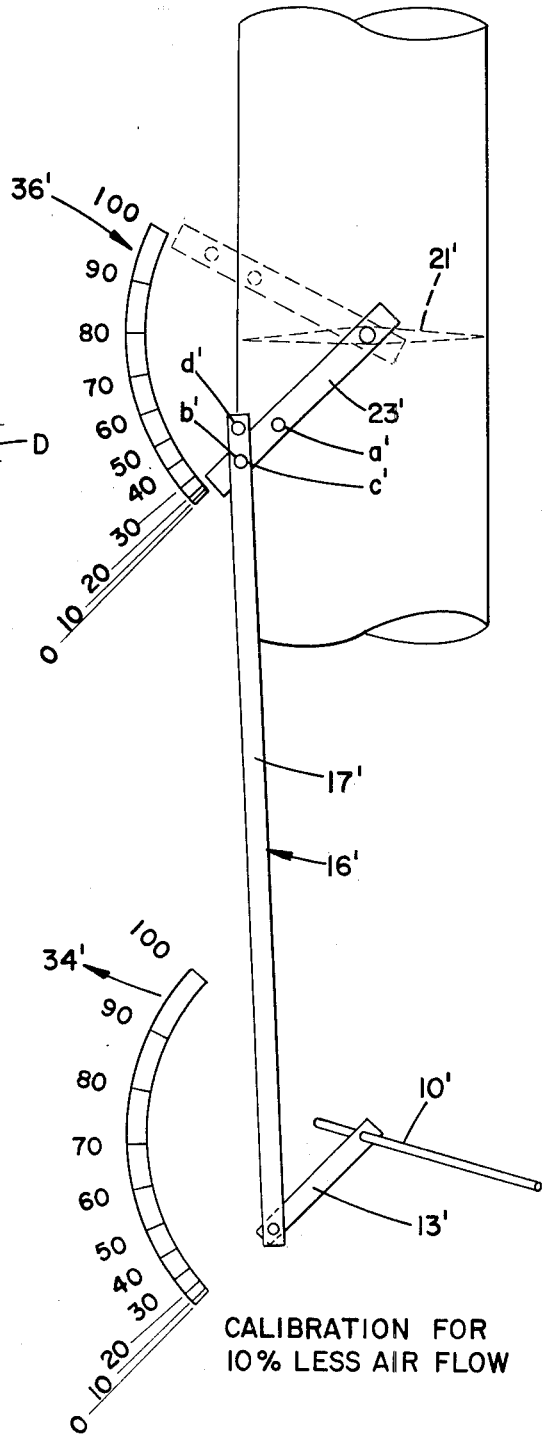

In order to achieve the reduced damper travel of FIG. 2B (approximately 73° in FIG. 2B instead of the original 90° in FIG. 2A) the effective length of any one of the three components of linkage 16' of FIG. 2B may be changed.

In FIG. 2B the calibration change has been effected by increasing the length of the driven lever 23' by causing the connecting link 17' to be interconnected to driven lever 23' at hole b'. Note that in FIG. 2A connecting link 17 is interconnected to driven lever 23 at hole a.

It will also be noted in FIG. 2B that in order to achieve the calibration shown it is necessary to decrease the length of the connecting link 17' from that shown in FIG. 2A. In order to decrease the length of connecting link 17' hole c' of the connecting link is brought into registry with hole b' of the driven lever 23'. The decrease in length is shown schematically in FIG. 2B as distance "D".

It should be understood that suitable pin connections are made in the holes shown in FIGS. 2A and 2B. For ease of description the pins themselves have been omitted.

To summarize, the schematic of FIG. 2B shows a recalibration of damper travel in order to provide for 10% less air flow for a given flow of fuel as compared to the original calibration shown in FIG. 2A. The recalibration was made as a result of adjusting the length of the driven lever 23' and the connecting link 17'. The length of the driven lever 23' was increased as will be observed in FIG. 2B. The length of the connecting link 17' was decreased for the purpose of maintaining the correct 0 position of the lever 23' on scale 36'.

It should be appreciated from a study of FIGS. 1A, 1B, 2A and 2B that recalibration of jackshaft type control mechanisms for combustion apparatus such as boilers and the like is not only time consuming, it disturbs boiler operation.

This invention provides for continuous correct linkage calibration at all times during the operation of the boiler in order to provide for efficient, smoke free operation under varying loads.

The preferred embodiment of the invention will be described in connection with the schematic of representation of FIG. 3. Similar reference characters will be used in FIG. 3 as were used in connection with the description of the schematic representations of FIGS. 1A, 1B, 2A and 2B.

Figure 3:
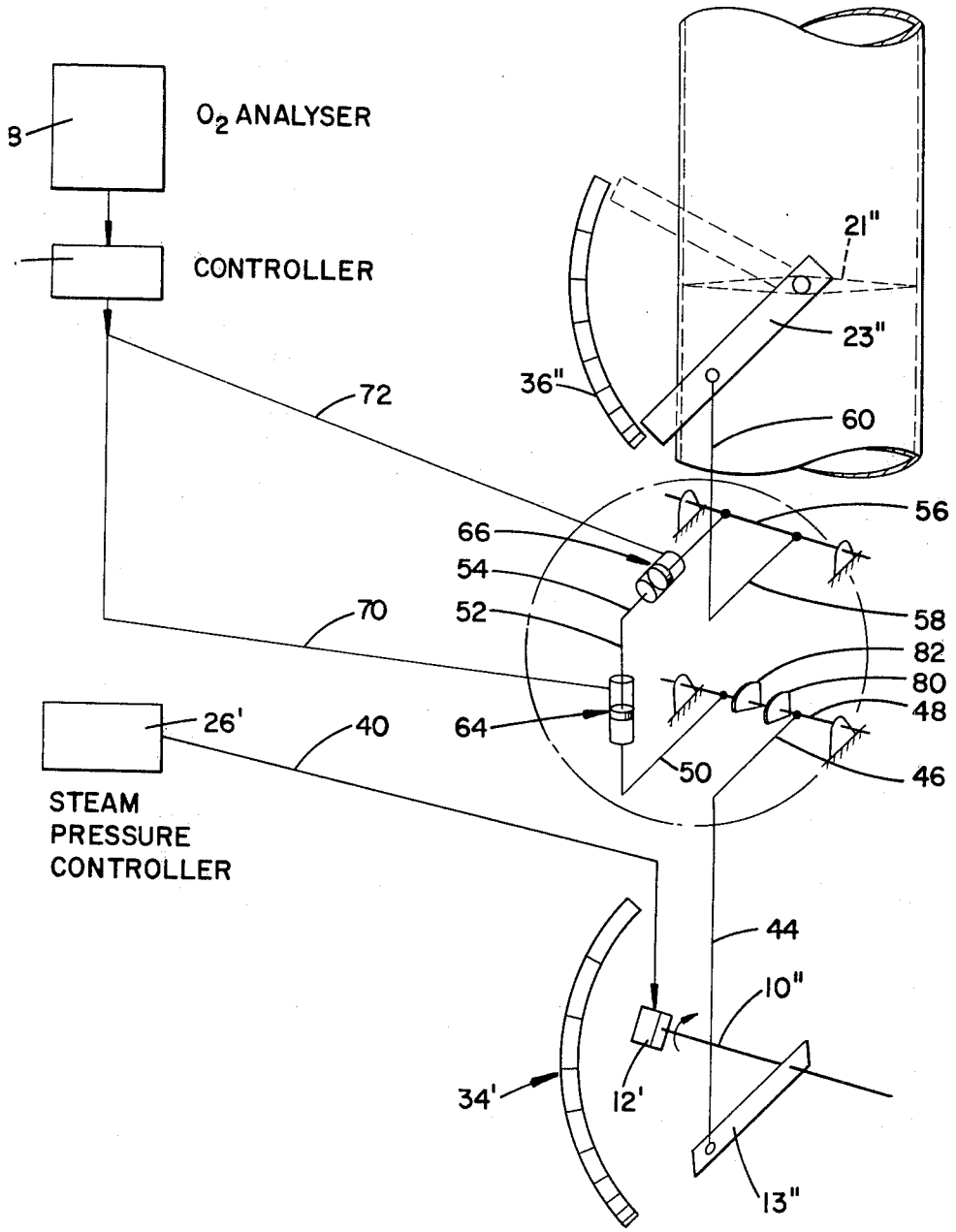
FIG. 3 is a schematic representation of the control system of this invention.

The elements of the preferred embodiment of the invention as shown in FIG. 3 comprise jackshaft 10'' which is adapted to be connected to the boiler in any known manner such as that shown in FIGS. 1A and 1B. Jackshaft 10'' is adapted to be turned by rotation means 12' which may take the form of an electric motor, hydraulic actuator or the like. The rotation means may receive a suitable control signal 40 from suitable apparatus such as a steam pressure controller 26'.

Rigidly fixed to the jackshaft 10'' is driving lever 13''. An input link 44 provides a connection between driving lever 13'' and input lever 46 which is affixed to input shaft 48. It should be understood that input shaft 48 is rotatably supported by suitable bearing means (shown schematically in FIG. 3). A second input lever (designated 50 in FIG. 3) is affixed to input shaft 48 and provides an interconnection with connecting link 52. Connecting link 52 is, in turn, connected to lever arm 54. One end of lever arm 54 is affixed to output shaft 56. Output shaft 56 is quite similar to input shaft 48 in that it is rotatably supported by bearing means shown schematically in FIG. 3. An output lever 58 extends from output shaft 56. Output link 60 provides an interconnection between output lever 58 and driven lever 23''.

As will be observed in FIG. 3, comprising at least a part of the linkage mechanism which connects driving lever 13'' with driven lever 23'', is a variable length linkage means for varying the effective length of either the linkage mechanism between the driving and driven levers or the effective length or radius of the driving or driven levers. More specifically the connecting link 52 and the lever arm 54 are provided with variable length means whereby the connecting link 52 and/or lever arm 54 may be lengthened or shortened in order to provide for a recalibration of the linkage interconnecting the jackshaft 10" with the damper 21".

In the preferred embodiment as shown in FIG. 3 the variable length linkage means is comprised of a piston and cylinder assembly 64 interconnected into the connecting link 52 and a piston and cylinder assembly 66 interconnected into the lever arm 54. The piston/cylinder assembly 64 will be designated the zero piston whereas the piston/cylinder assembly 66 will be designated the range piston. As can be seen in FIG. 3 the range piston 66 can be extended or retracted to change the effective length of the lever arm 54. Similarly the zero piston 64 can be extended or retracted to change the effective length of the connecting link 52.

The changes in length of connecting link 52 and lever arm 54 are, in the preferred embodiment, made remotely by means of signals 70, 72 emanating from controller 74. The controller is, in turn, interconnected into sensing apparatus which, in the preferred embodiment, is an oxygen analyzer 78.

By making the connecting link and lever arm changes through remote control, the recalibration of the linkage extending from the driving lever 13" to the damper 21" can be performed at any time, or continuously, without disturbing automatic boiler operation.

In operation, the preferred embodiment of the apparatus of this invention of FIG. 3 provides for a continuous reading of oxygen levels in the boiler. A deviation of $O_2$ readings from the desired set point generates a corrective control signal which is sensed to position the range in zero actuators 66, 64. At mid-signal range, output shaft rotation 56 equals input shaft rotation 48 resulting in a linkage calibration as originally adjusted. At the lower half of the signal range (i.e., as the corrective signal decreases toward 0) output shaft rotation gradually reduces relative to input shaft rotation. At the upper half of the signal range, output shaft rotation increases relative to input shaft rotation. Maximum correction or adjustment provided by the preferred embodiment of this invention is plus or minus 15%. The zero piston 64 may be calibrated to properly change the length of the connecting link 52 whenever the range piston 66 is adjusted in order that the zero point calibration of the linkage is always correctly maintained. This relationship may be varied if desired, however.

The effectiveness of a burner's mixing of air and fuel decreases with load. Thus, more excess air ($O_2$) is required at low load than at high load. Typical values of excess air will vary from about 2% $O_2$ at high load to 5% $O_2$ at low load. The burner service technician programs this requirement into his linkage calibration. A fixed set point $O_2$ trim control system of the type shown schematically in FIG. 2B will, of necessity, maintain the same $O_2$ at all loads resulting in smoke and combustibles at low loads. Alternately, if the calibration is initially made to meet a low load condition, high excess air will result at high loads.

This invention provides at the input shaft 48 a pair of cams 80, 82. Cam 80 is designated the oil cam whereas cam 82 is designated the gas cam. Cams 80, 82 develop the proper set point program for the $O_2$ controller based on the type of fuel being used. This is necessary because of the fact that excess air versus load requirements are different for each fuel. As the master jackshaft 10" rotates in proportion to boiler load, the correct $O_2$ set point for that load, and for the fuel being burned, is transmitted to the controller 74 by means of suitable signal generating apparatus 76 responsive to the rotation of cams 80, 82. Common place apparatus for converting mechanical position or movement to a corresponding electrical signal includes variable voltage sources, variable current sources, oscillators and the like which include a variable resistor, capacitor, inductor or the like, which electromechanical apparatus is connected with the mechanical part so as to have its electric value varied by movement of the mechanical part.

This invention, therefore, provides for a continuously self-calibrating controller with automatic $O_2$ set point programming for individual fuels.

Because of the inherent time lag in the combustion system, in effecting the air and fuel flow changes, in mixing, combustion, and the passage of combustion gases along to the sampling point, it must be appreciated that $O_2$ trim plays no part in maintaining proper fuel-air ratios during a step load change. The calibration of the linkage which positions the air damper relative to the fuel valve solely determines the fuel-air ratio during and immediately after a load change.

Figure 4:
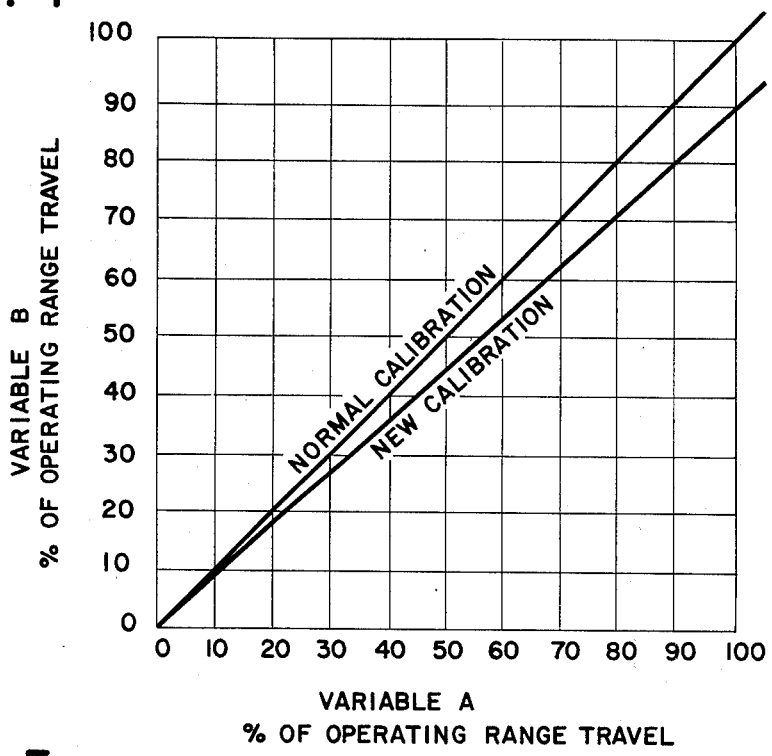
FIG. 4 is a graphic representation of a calibration range change made with respect to two flow control devices of combustion apparatus.

FIG. 4 shows a graphic representation of a typical relationship between two flow variables in a combustion apparatus. If changes occur which require this relationship to be changed so that, for example, 100% of variable A (fuel for example) coincides with 90% of variable B (air for example) and the effect is proportioned throughout the range, then a new calibration relationship is required as illustrated. FIG. 4 shows, therefore, a 10% less air flow calibration wich is the same calibration shown schematically in FIG. 2B.

The change in calibration illustrated in FIG. 4 is known as a range change. In a linkage type of control system as shown in FIG. 2B the range change is effected by changing the radius of the driven lever 23'. In the preferred embodiment of this invention as shown in FIG. 3, the range change is effected by changing the radius or length of the lever arm 54.

Referring once again to FIG. 2B a range change may similarly be effected by decreasing the length of driving lever 13'. Similarly with respect to the preferred embodiment of this invention as shown in FIG. 3 a range change may be effected by decreasing the length of either one of the input levers 46, 50 or output lever 58.

As noted above the adjustment in length of connecting link 52 of the preferred embodiment of FIG. 3 provides for a zero adjustment in order that the "normal calibration" and "new calibration" curves of FIG. 4 will both intersect the zero point of the graph of FIG. 4.

While in the preferred embodiment zero adjustment is achieved by making a length adjustment with respect to the connecting link 52, a similar zero adjustment may be achieved by altering the length of the input link 44 or the output link 60.

Figure 5:
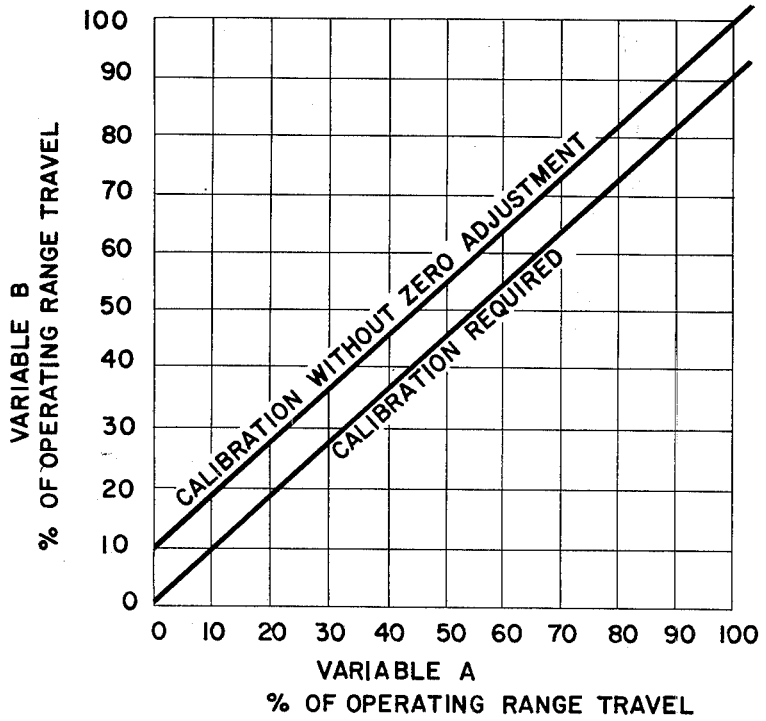
FIG. 5 is a graphic representation of a calibration zero adjustment made with respect to two flow control devices of combustion apparatus.

FIG. 5 is similar to FIG. 4 but shows a graphic representation of zero adjustment.

To briefly summarize, this invention provides a means of changing the calibration between two flow regulating variables by remote, manual or automatic control. As shown in FIG. 3, the length of the connecting link 52 and lever arm 54 can be changed if required to maintain the desired calibration when changes are necessary. The changes in length of the connecting link and lever arm can be made by any power device, electric motor, pneumatic or hydraulic piston, or other device which can effect a change in length in response to a signal which, in the preferred embodiment, is derived from an oxygen analyzer in the flue gas of the combustion apparatus.

An additional advantage of this invention is the fact that it provides a means to calibrate a fixed linkage jackshaft type of control apparatus (to provide for both range changes and zero adjustment) which is relatively inexpensive and which may be installed in an existing jackshaft installation of the type shown in either FIG. 1A or 1B.

The apparatus of this invention may, in addition, be equipped with a position transmitter for feeding back to the automatic controlling mechanism 74 information concerning the position of the operating range of the flow regulating device or devices, and the rate of change of the devices. With this information, the automatic control device 74 can be designed to make no calibration corrections during rapid transient conditions, or when upper or lower operating limits have been reached. The automatic control device can, by knowing the position in the operating range, be designed to make range calibration adjustments only in the upper portion of the operating range and/or make zero calibration adjustment only in the lower portion of the operating range as will be described more fully below.

Figure 6:
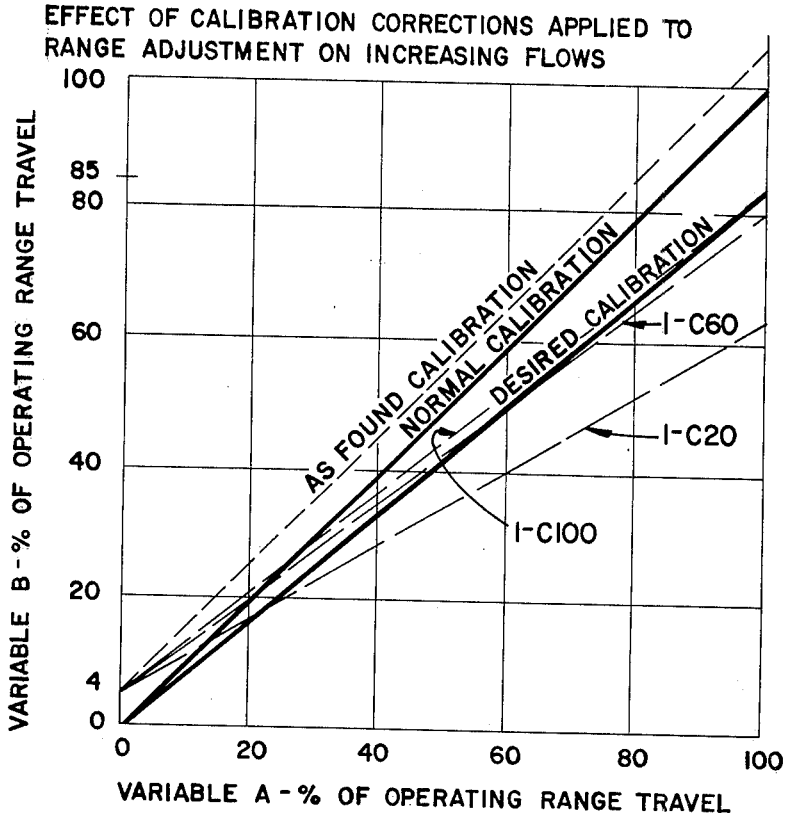
FIG. 6 is a graphic representation of a calibration range change made on increasing flows.
Figure 7:
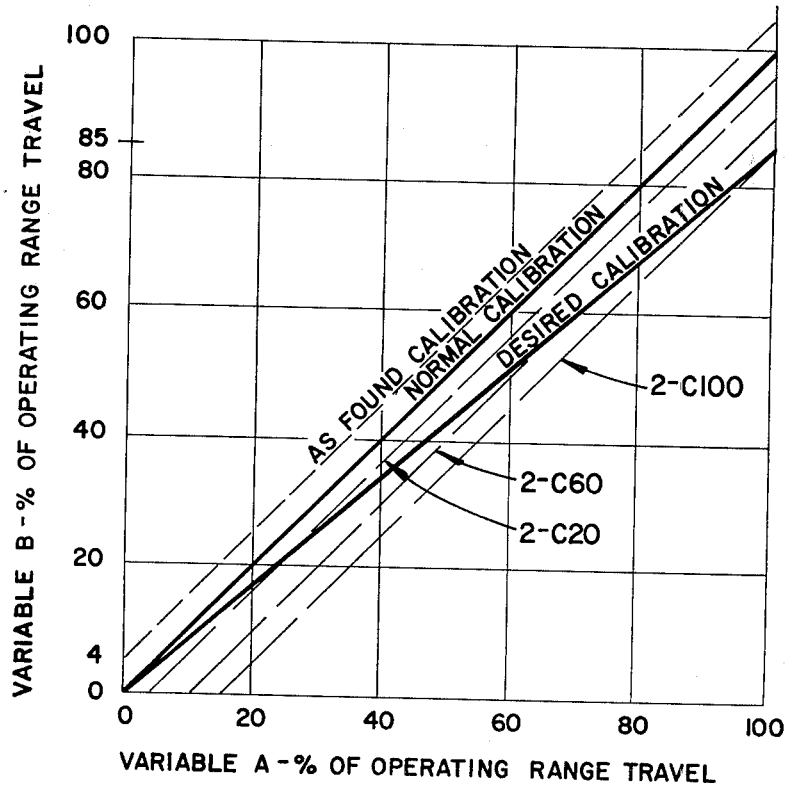
FIG. 7 is a graphic representation of a calibration zero adjustment made on increasing flows.
Figure 1A:
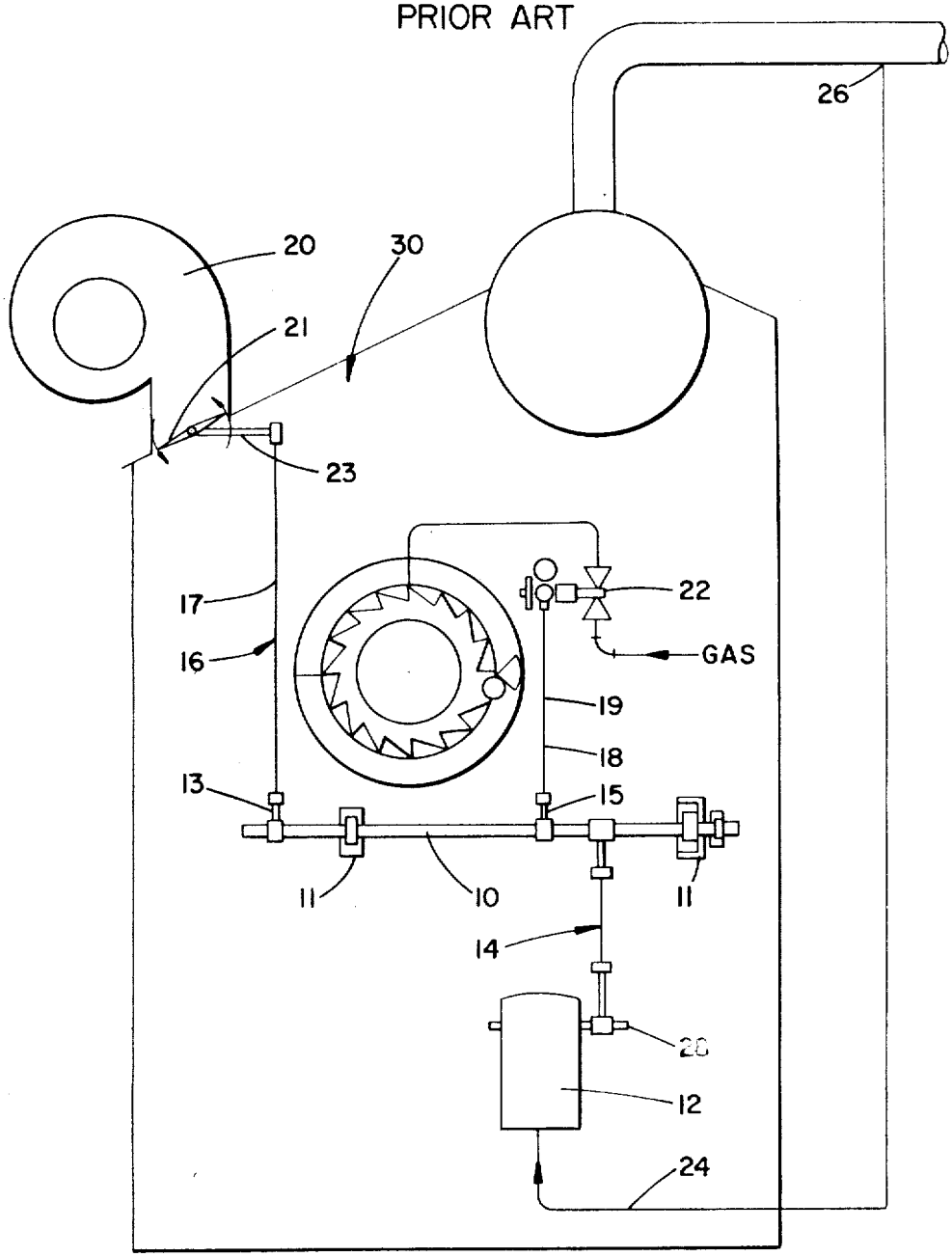
FIG. 1A PRIOR ART
Figure 1B:
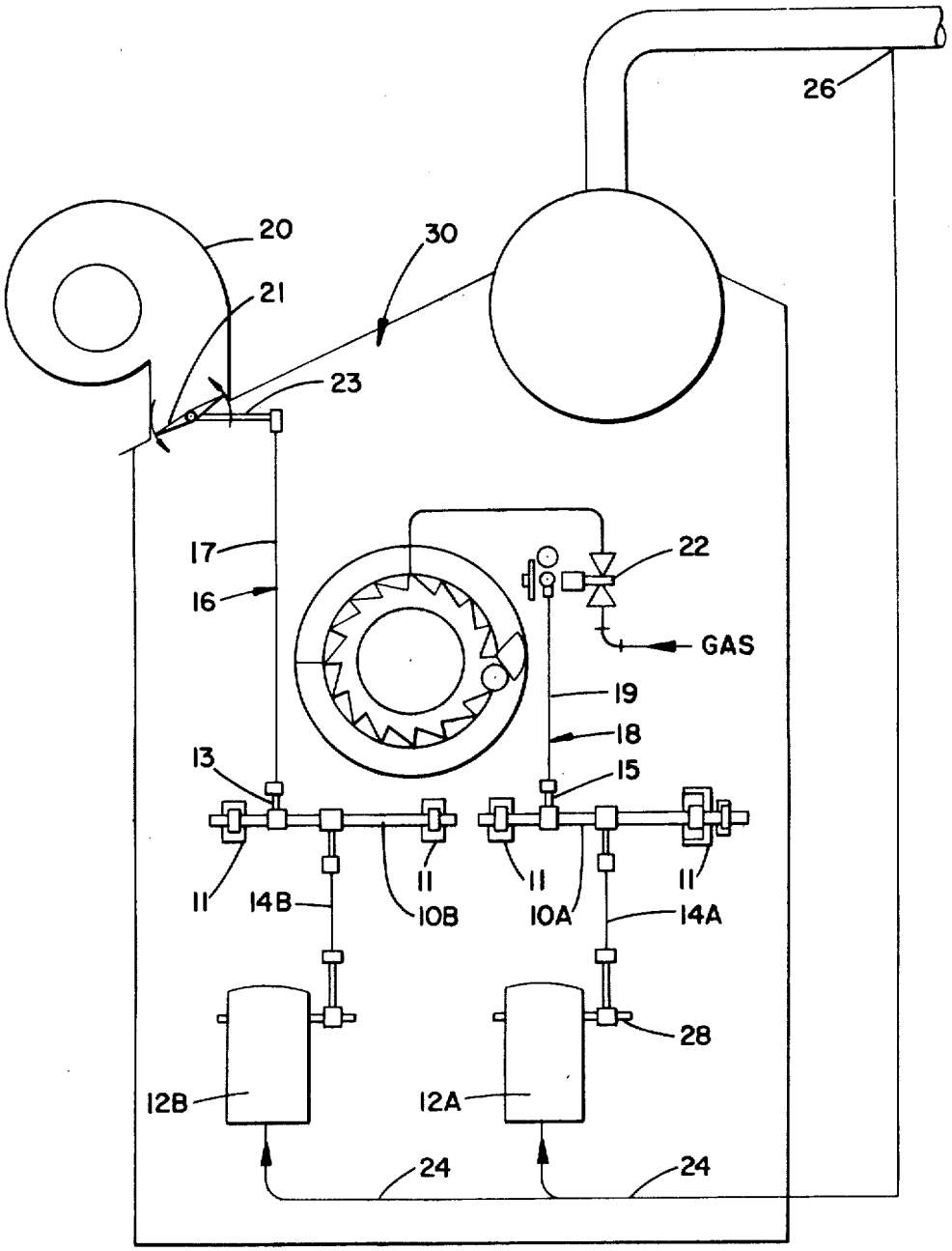
FIG. 1B PRIOR ART
Figure 2A:
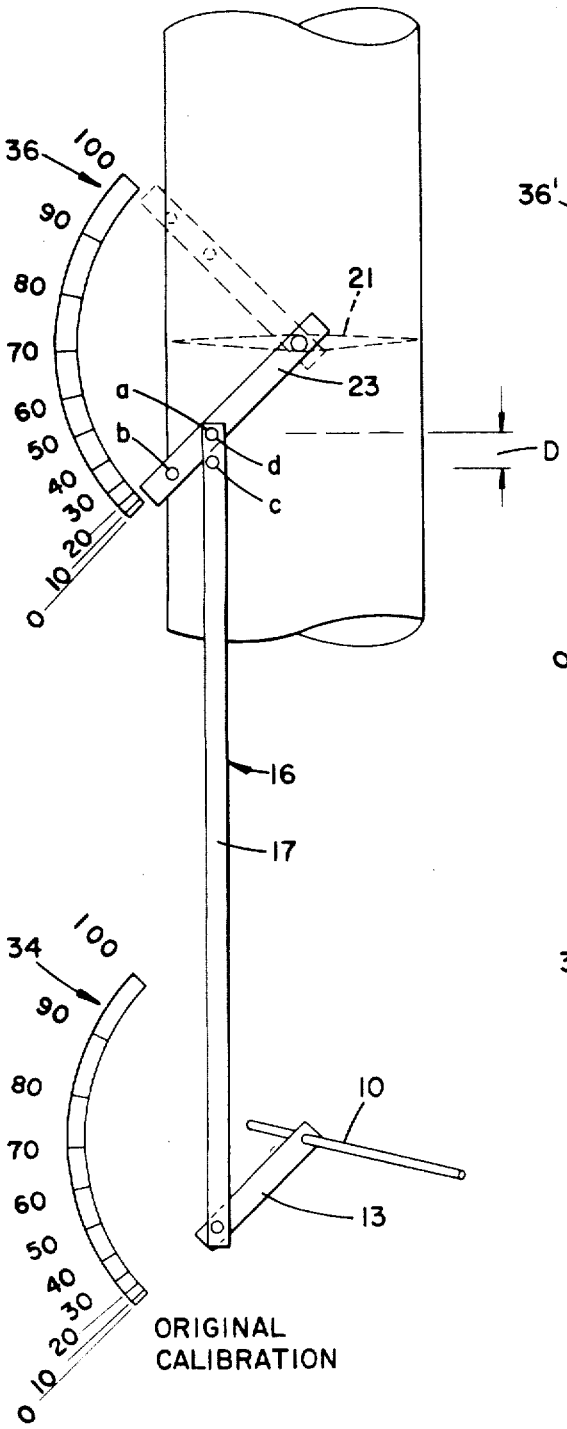
FIG. 2A PRIOR ART
Figure 2B:
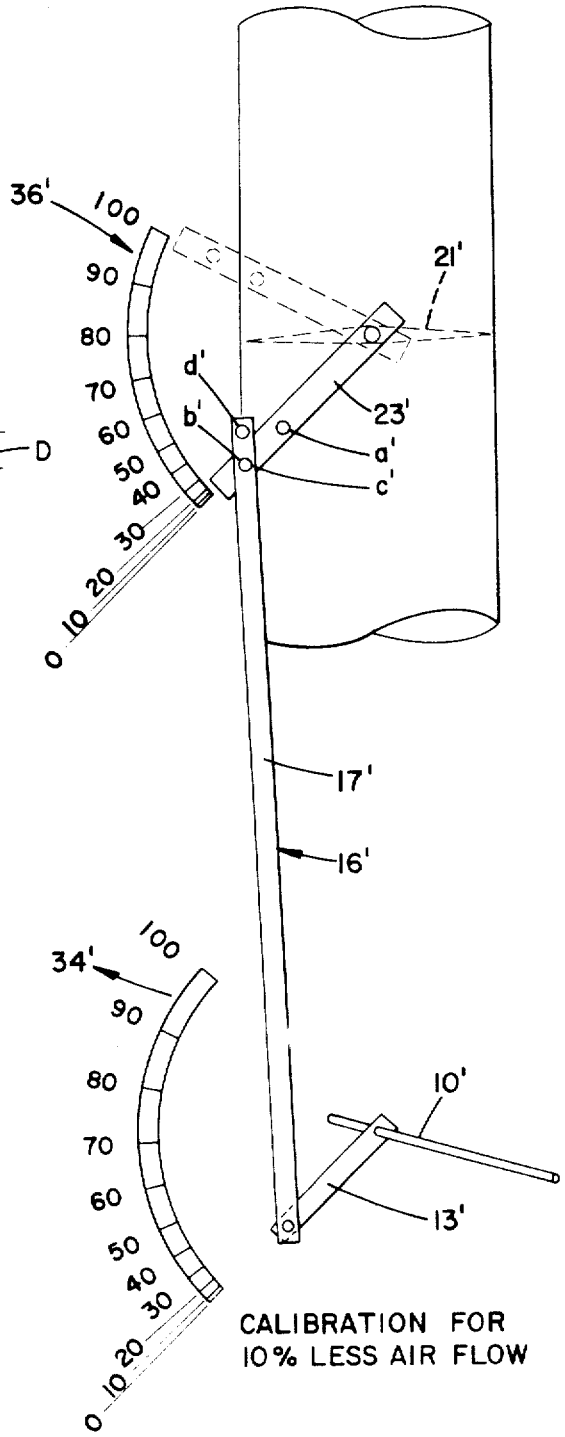
FIG. 2B PRIOR ART
Figure 3:
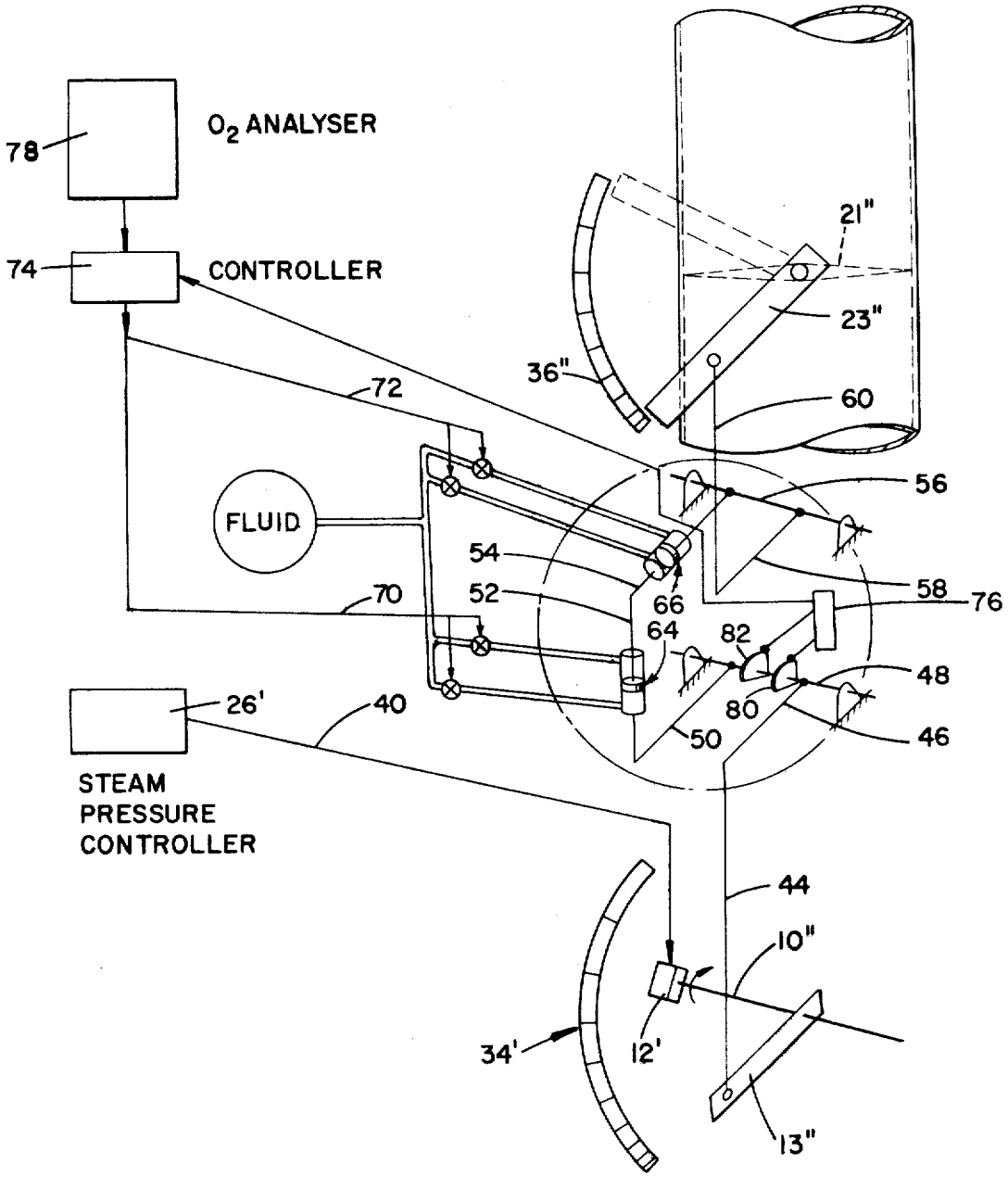

FIGS. 6, 7 and 8, show, graphically, a refinement in the operation of the apparatus of this invention wherein range corrections and zero corrections are made during periods of specific flow fluctuation.

FIG. 6 illustrates an "as found" calibration which differs from the "desired" calibration by both a zero change and a range change. An analytical instrument or other mechanism capable of detecting the deviation between "as found" and "desired" ratio calibrations (as for example an oxygen analyzer) is used to generate a corrective signal. By applying this corrective signal to the range calibration adjustment mechanism (i.e., piston 66 of FIG. 3) the resulting calibration is represented by the line i-C20. Subsequent range calibration adjustments automatically made at flows of 60% and 100% are represented by lines i-C60 and i-C100. These calibrating actions at successively increasing flows show progressive improvement in establishing a calibration curve which approximates the "desired" characteristic.

Conversely, if, as shown in FIG. 7, the corrective actions at increasing flows are applied to the zero adjustment of the device, the successive calibrations, as shown by lines 2-C20, 2-C60 and 2-C100, result in a calibration, line 2-C100 which is not as close to the "desired" calibration as is line 1-C100 in FIG. 6. This indicates that on increasing flows, the most effective corrective action is that applied to the range adjustment.

In FIG. 8 the calibration achieved in reaching 100% flow is represented by line 3-C100, which is identical to line 1-Ch00 of FIG. 6. If during and/or after flow decreases the corrective action is applied to the zero calibrating adjustment of the device, as illustrated by lines 3-C60 and 3-C20, it will be noted that the zero calibration is approaching the "desired" calibration.

Conversely, if corrective actions at decreasing flows are applied to the range adjustment of the device, rather than the zero adjustment, the calibration at 60% flow would be represented by line 1-C60, FIG. 6, and that at 20% flow by line 1-C20, FIG. 6, with no improvement toward the "desired" calibration.

Consequently, by applying range corrections during and/or after flow increases and zero corrections during and/or after flow decreases, both range and zero calibrations move progressively and automatically toward the desired calibration as the process experiences fluctuations in flow. If there is no change in flow rate, the corrective action makes the calibration correct at that one point, and calibration at other flow points does not matter as they are not being used.

An improvement on the above is to arrange circuitry so that on flow decreases the corrective action to the zero adjustment is maintained only long enough to stabilize out at that point. A time delay or deviation detector, or other mechanism then switches the corrective action to the range adjustment. Thus if flow remains at that point for a protracted period of time, any further ratio corrections required would likely be of the type requiring range rather than zero correction.

On combustion or other processes, where rapid changes in firing rates or flow rates are encountered, a further refinement is to "lock up" the control system so that no corrective action occurs during transient conditions. Due to time lags, analytical measurements are not always representative during transients and therefore may be undesirable as a basis for corrective action. A further refinement is to automatically increase the range adjustment a specific amount during an increasing transient, effectively causing air flow to lead fuel flow during the transient to insure complete combustion with no smoke. This added signal would be removed as soon as the transient stops and gives way to steady state conditions.

It should be noted that the circuitry of this invention is arranged so that whenever a corrective signal is switched, i.e., from range to zero calibration adjustment, the last range calibration is locked in and held until corrective action is again switched to the range adjustment for further range calibration. Zero calibrations are similarly locked in while no corrective action is applied.

MODIFICATIONS OF THE PREFERRED EMBODIMENT

While in the preferred embodiment the control system is responsive to an oxygen analyzer having a probe positioned in the flue gas of the combustion apparatus it should be understood that other analytical devices may be used. It should also be understood that this invention is applicable to systems generally employing flow control devices (such as systems found in the chemical process industry) responsive to analytical devices including pH meters, conductivity meters, spectrometers, gas analyzers and the like.

Similarly, while in the preferred embodiment the variable linkage means has been described as a piston/cylinder assembly acted upon by air or hydraulic fluid it should be understood that other mechanisms and apparatus by means of which variable control of flow regulating devices is achieved should be within the spirit of this invention. One such modified form of variable linkage adjustment means is shown in FIG. 9 wherein an electrical motor 84 rotates an adjustment screw 86 in order to adjust the length of linkage 88.

METHOD

The method of this invention has been described in connection with the continued references to the preferred embodiment of the apparatus shown in FIG. 3. Applicant's method broadly provides for the steps of:

(a) sensing flow and mix conditions in the flue of a combustion apparatus and generating a control signal;

(b) using the control signal as a means of refinement or calibration of relative range and relative zero adjustment of two flow regulating devices. The flow regulating devices may be linked together or operated by a single drive means or, alternately, the flow regulating devices may be independently driven or controlled by separate drive means receiving a single signal from a common source.

What is claimed is:

1. A control system for apparatus of the type in which two flow control devices operate in a relationship to one another, said control system comprising:

(a) a jackshaft system driven by rotation means responsive to a first control signal, said jackshaft system having an interconnection to said flow control devices;

(b) variable length linkage operatively connecting said jackshaft system and at least one of said flow control devices, said variable length linkage comprising:

(i) a first lever operatively connected with at least a part of said jackshaft system;

(ii) a connecting link having one end thereof operatively connected to said first lever;

(iii) a lever arm having one end thereof operatively connected to said connecting link;

(iv) a driven lever associated with said one flow control device and operatively connected to said lever arm;

(v) means to adjust the length of said connecting link in response to second control signal;

(vi) means to adjust the length of said lever arm in response to a second control signal, whereby the application of a second control signal to either one or both of the adjustment means of said connecting link and said lever arm produces an alteration in said variable length linkage with a subsequent change in relationship of said flow control devices.

2. The invention of claim 1 in which said means to adjust the length of said connecting link and said lever arm is comprised of a fluid actuated piston-cylinder assembly.

3. The invention of claim 1 wherein said first lever is a driving lever which is disposed for rotation with said jackshaft system and further comprising an input shaft, means for connecting the driving lever with the input shaft whereby the input shaft rotates in response to rotation of the jackshaft system, an input lever connected with said input shaft for rotation therewith and pivotally connected with said connecting link, an output shaft connected with said lever arm for rotation therewith and means for connecting the output shaft with the driven lever.

4. The invention of claim 3 in which said input shaft is provided with fuel adjustment cams.

* * * * *

UNITED STATES PATENT AND TRADEMARK OFFICE

CERTIFICATE OF CORRECTION

PATENT NO. : 4,264,297

DATED : April 28, 1981

INVENTOR(S) : Robert A. Van Berkum

It is certified that error appears in the above—identified patent and that said Letters Patent is hereby corrected as shown below:

In the Drawings, Figures 1A, 1B, 2A, 2B and 3, should appear as shown on the attached sheets.

Signed and Sealed this

*Eighteenth* Day of *August 1981*

[SEAL]

*Attest:*

GERALD J. MOSSINGHOFF

*Attesting Officer*

*Commissioner of Patents and Trademarks*